US005485798A

United States Patent [19]

Samoian et al.

[11] Patent Number: 5,485,798

[45] Date of Patent: Jan. 23, 1996

[54] BOAT LIFT

[76] Inventors: Ronald P. Samoian, 2022 Montauk Ct.; Scott R. Rister, 2032 Montauk Ct., both of Byron, Calif. 94514

[21] Appl. No.: 218,062

[22] Filed: Mar. 24, 1994

[51] Int. Cl.[6] ..... B63C 1/00

[52] U.S. Cl. ..... 114/44; 405/3

[58] Field of Search ..... 114/44, 45, 263, 114/48, 267; 405/3

[56] References Cited

U.S. PATENT DOCUMENTS

| | | | |
|---|---|---|---|
| 3,265,024 | 8/1966 | Kramlich | 114/45 |
| 4,602,587 | 7/1986 | Lyons | 114/267 X |
| 4,895,479 | 1/1990 | Michaelsen et al. | 405/3 |
| 5,099,778 | 3/1992 | Paleu | 114/45 |
| 5,184,914 | 2/1993 | Basta | 114/44 X |
| 5,275,505 | 1/1994 | Wilcox | 114/44 X |

FOREIGN PATENT DOCUMENTS

| | | | |
|---|---|---|---|
| 0128896 | 6/1987 | Japan | 114/263 |

*Primary Examiner*—Sherman Basinger
*Attorney, Agent, or Firm*—Henry P. Sartorio

[57] ABSTRACT

A free floating fully self contained boat lift has two floats which support a cantilever lifting device. The floats support the weight of the lift and the boat and always remain afloat. The cantilever lifting device has two hydraulic rams operated by water at household pressure. The rams raise and lower a cantilever which supports the boat hull. Once the lift is raised, it is locked in place by a locking mechanism. A pair of control valves regulate water to the rams.

6 Claims, 5 Drawing Sheets

BOAT LIFT

BACKGROUND OF THE INVENTION

The invention relates to lifts for raising boats out of the water while docked.

When a boat is left in the water too long, damage to the boat occurs. Therefore, a variety of different types of boat lifts have been developed so that when the boat is docked, the hull can be raised above the water level. Some boat lifts sit on the bottom of a lake or other body of water and mechanically raise the boat up. These lifts are generally not useful in waters where tidal action occurs because of the continuously changing water levels. Other types of boat lifts utilize flotation devices which are raised or lowered in the water. The prior art boat lifts are generally cumbersome to operate.

SUMMARY OF THE INVENTION

Accordingly, it is an object of the invention to provide an improved boat lift.

The boat lift of the invention is a free floating fully self-contained apparatus having two floats which support the weight of both the lifting device and the boat. The floats remain floating at all times. The lifting device is a cantilever apparatus with two hydraulic rams to raise and lower the cantilever. The rams are operated by water supplied through control valves from an ordinary household source (approximately 50 psi). Once the lift is raised, it is locked in place by two steel pins. The boat and lift are lowered by pulling the pins out of the rams and releasing the water from the rams.

DETAILED DESCRIPTION OF THE INVENTION

Figure 1A:
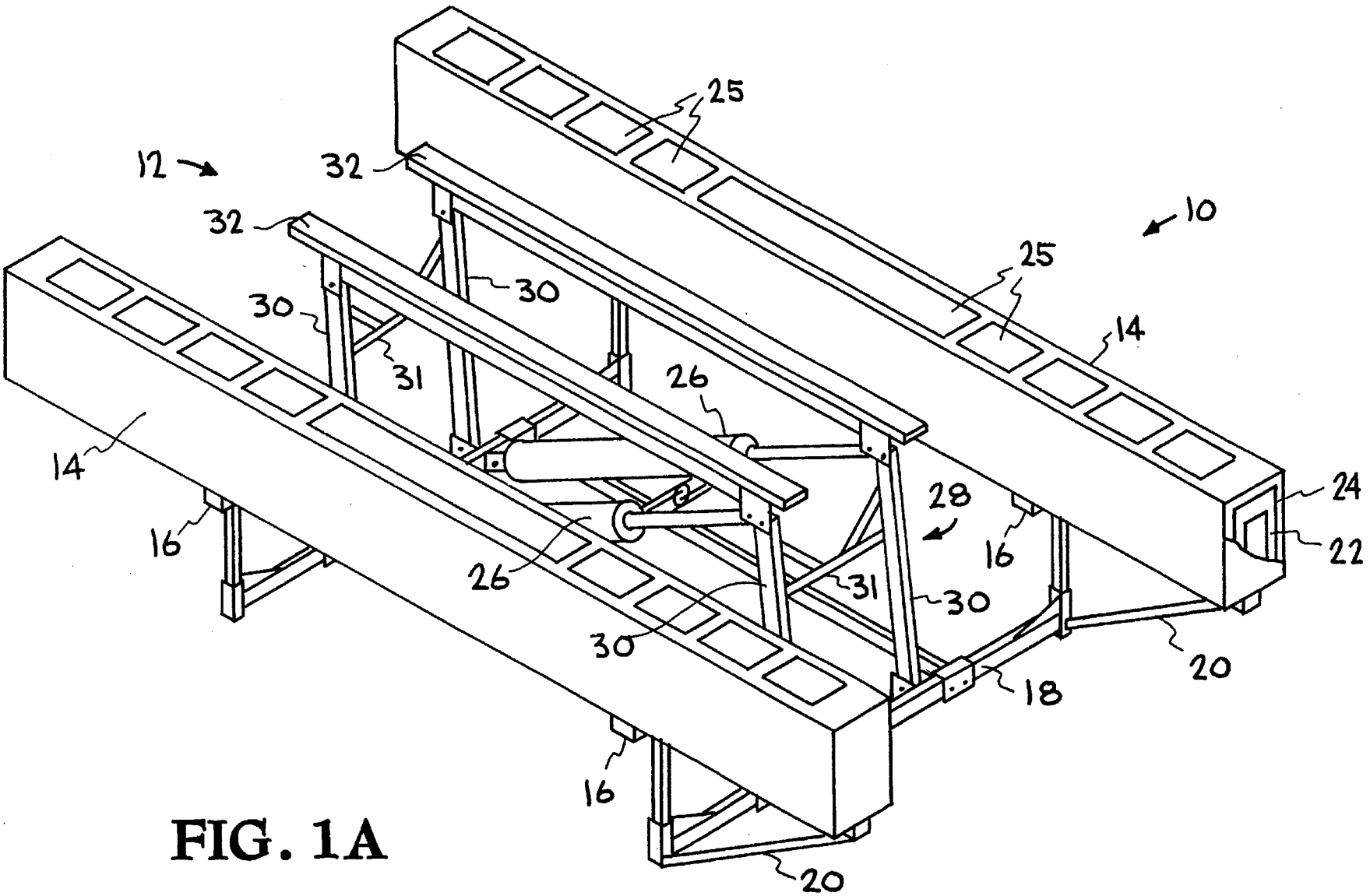
FIGS. 1A, B are perspective views of the boat lift.
Figure 1B:
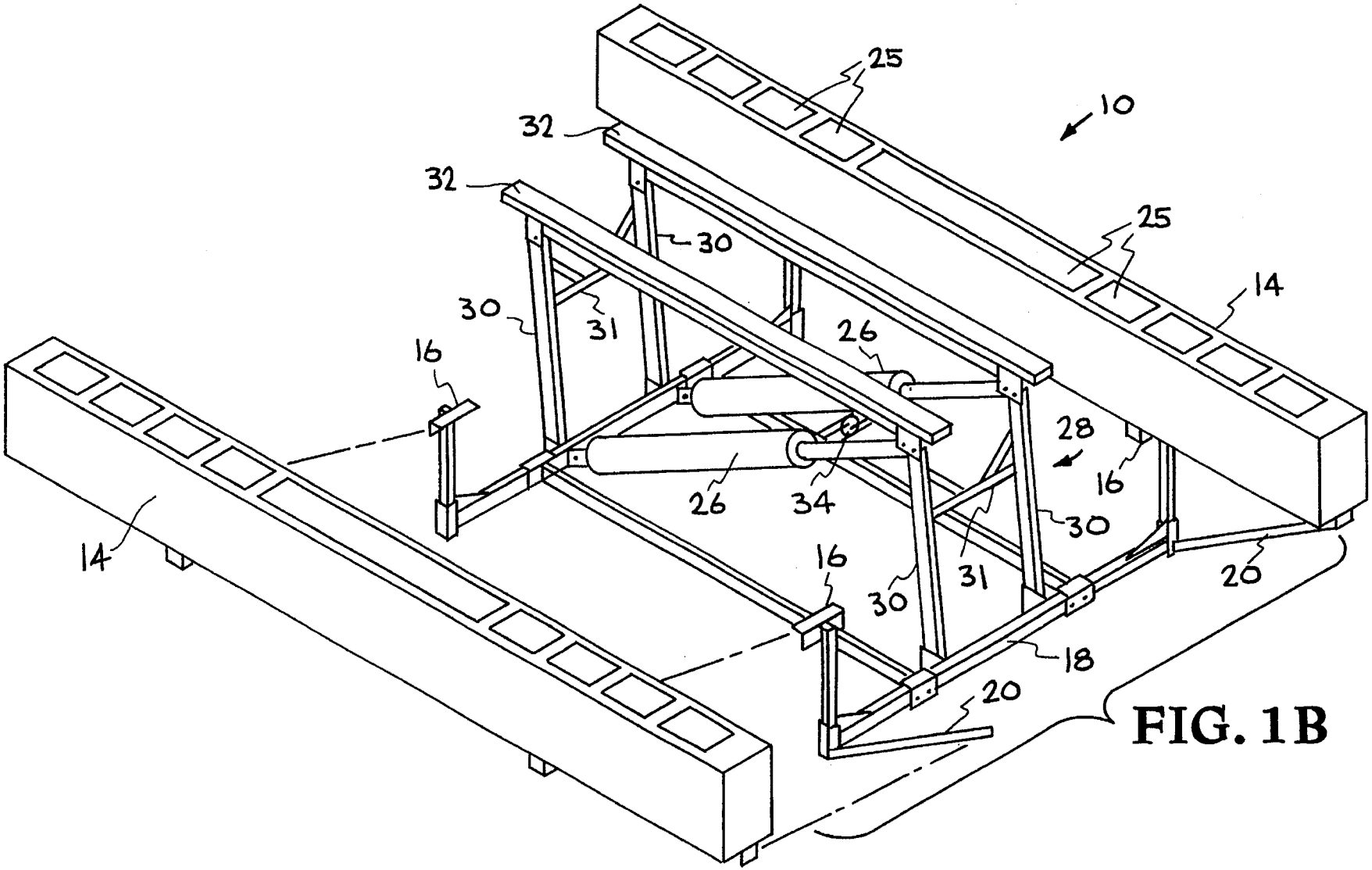

As shown in FIGS. 1A,B and 2A–C, boat lift 10 is formed of a cantilevered lifting apparatus 12 supported by two floats 14. The floats 14 are attached to support mounting brackets 16 which are connected to base frame 18. Support struts 20 also extend from frame 18 to floats 14.

The floats 14 are constructed of fiberglass and polyurethane sheets, made in a common mold. The end of one float 14 is shown partly in section in FIG. 1A to show the structure. The polyurethane foam sheets 22 are enclosed in a fiberglass casing 24 to make a strong, lightweight float 14. The polyurethane foam sheets 22 add structural rigidity to the float 14 and keep the float 14 from sinking if the fiberglass casing 24 is accidentally punctured. The floats 14 are configured to accept the mounting brackets 16 to which the lift mechanism is mounted. The mounting brackets are bonded into the floats in a configuration which prevents leakage into the floats at the mounting bracket location, or otherwise suitably attached. Roughened areas 25 are formed on the top surface of floats 14 during the molding process to act as nonskid pads.

The floats 14 support the weight of both the lift mechanism 12 and a boat, and always remain afloat. The lift mechanism is positioned below the water so the boat can be positioned above the lift mechanism. Because of the integral mounting of the floats to the lift mechanism, there are no protruding bolts or other obstructions which can damage the boat. Unlike many other boat lifts, this lift does not use the dock to aid in supporting the weight of the boat or the weight of the lift. Nor does the lift stress the dock while it is lifting or lowering the boat. The only attachment to the dock is to prevent the lift from floating away. Either side or the front end of the boat lift 10 can be attached to a dock, or the lift 10 can be anchored without a dock. The free side(s) of lift 10 can be used to tie other boats.

The lifting apparatus 12 is a cantilever design with two hydraulic rams 26 to push up the cantilever 28. Cantilever 28 is formed of four pivoting arms 30 which are pivotably mounted, as spaced front and rear pairs, to the base frame 18. Crossbars 31 connect the front and rear pairs of arms. The two hydraulic rams 26 are pivotably mounted at one end to frame 18, adjacent two arms 30, and at the other end to the distal ends of the other two arms 30. Boat bunks 32 on which the boat hull sits are pivotably mounted between a front and rear pair of arms 30. Thus when the rams 26 are in the retracted position, the arms 30 are pulled down to a substantially horizontal position, lowering the level of the attached boat bunks 32 to below the water level (and boat hull). When rams 26 are extended, they push the arms 30 to a vertical position, thereby raising the level of boat bunks 32 which contact the boat hull and allow the hull to be raised out of the water.

The rams 26 use water supplied by an ordinary household bib for its source of fluid and pressure. At 50 psi (average household water pressure) each ram 26 puts out approximately 2500 lbs of force. Because the hydraulic fluid being used is water, there is no concern that a leak may be harmful to the environment.

Figure 2A:
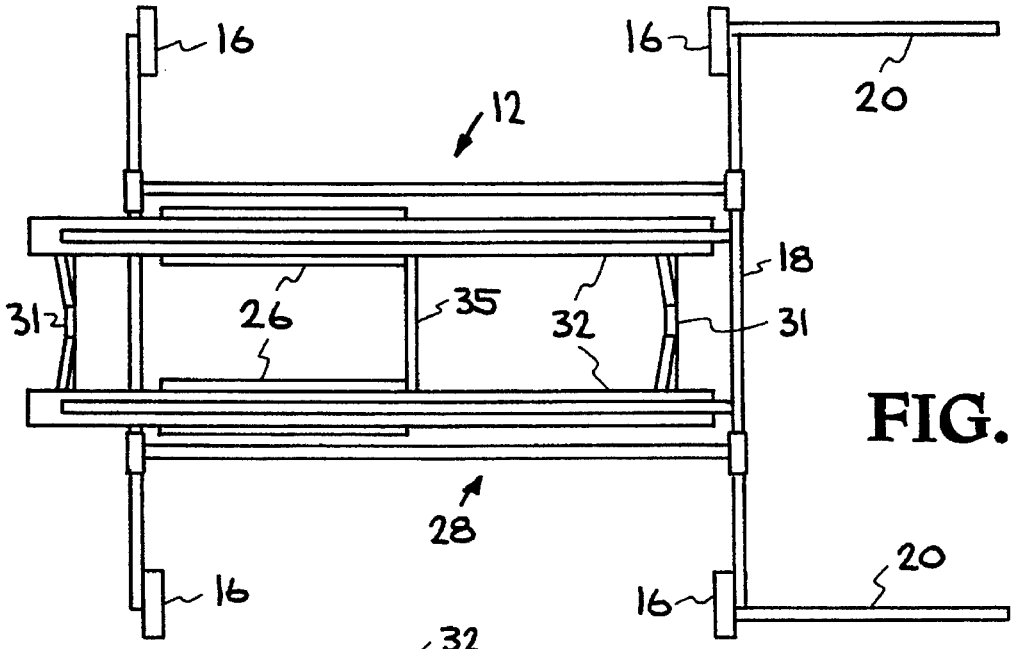
FIGS. 2A–C are top, side and end views of the lifting mechanism.
Figure 2B:
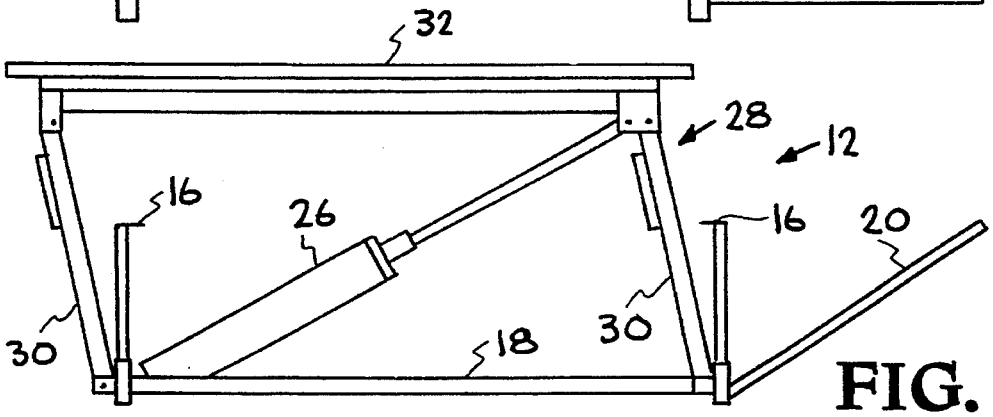
Figure 2C:
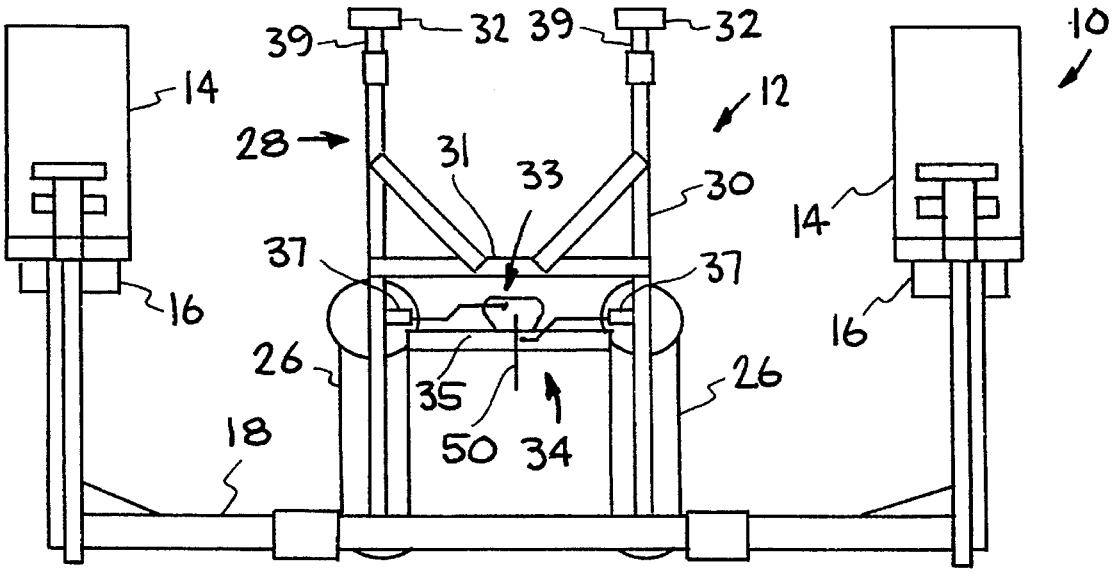

Once the lifting apparatus 12 is raised, it is locked in place by a locking mechanism 34 which pushed two ¾" stainless steel pins into holes in the rams 26. As shown in FIG. 2C, locking mechanism 34 is mounted on crossbar 35 which extends between the two rams 26. Cable 50 is attached to a cam mechanism 33 which pushes or retracts pins 37 into or out of rams 26. Once the lock mechanism 34 is set, the lifting apparatus 12 cannot go down even if the hydraulic system develops a leak. The boat and lift are lowered by releasing the lock mechanism 34, i.e. by pulling the pins from the rams 26, and then releasing water from the rams 26. The weight of the boat will drive the lift down (a minimum load of about 600 lbs is required).

Figure 2D:
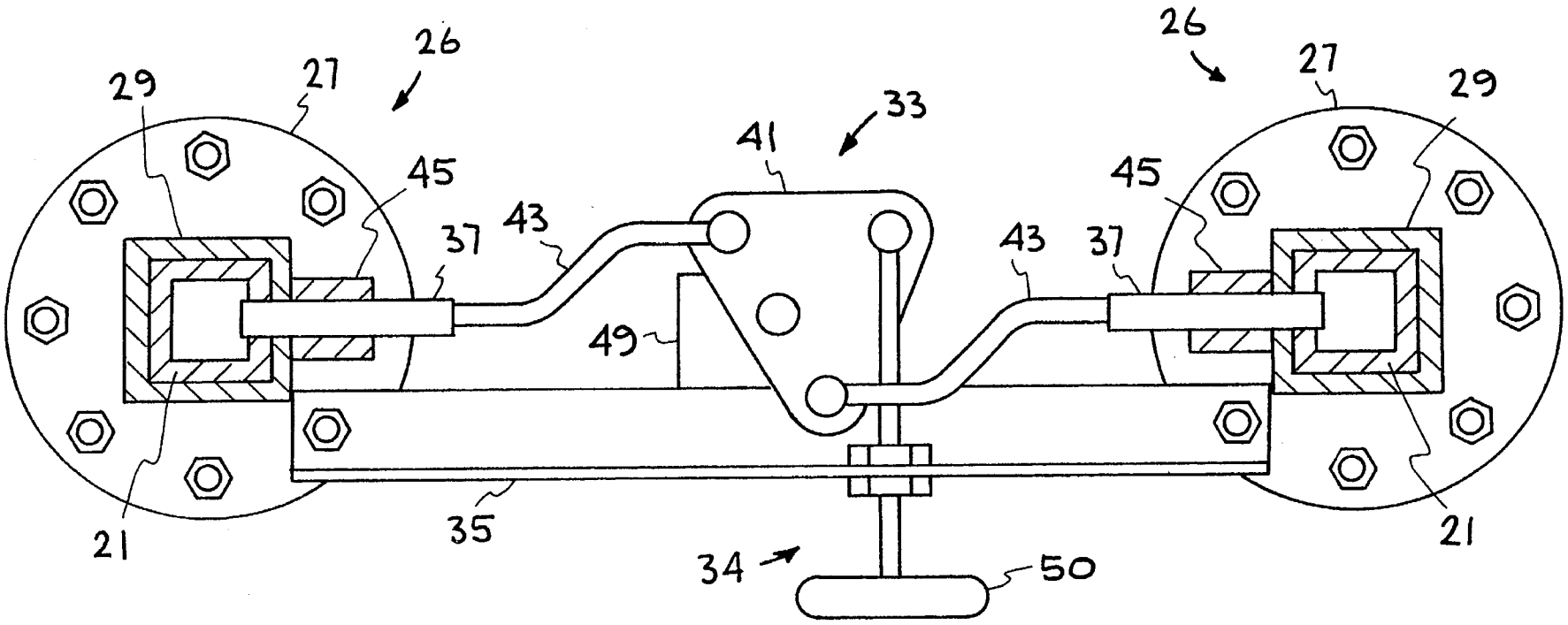
FIG. 2D is a more detailed view of the locking mechanism.

As shown in FIG. 2D, locking mechanism 34 is connected to the hydraulic rams 26. Each ram 26 is formed of a cylinder 27 having a guide 29 in which a telescoping arm 21 is mounted so that it can be moved between retracted and extended positions. Crossbar 35 is connected between the rams 26 and has a flange 49 extending therefrom, on which a cam 41 is pivotably mounted. Push-pull cable 50 is connected to the cam 41 to rotate the cam. A pair of connecting rods 43 are also connected to cam 41 and are extended or retracted by cam mechanism 33 as the cam 41 is rotated. A pin 37 is connected to the distal end of each rod 43 from the cam 41 and is inserted into or retracted from the guide 29 by the action of the cam mechanism 33 to lock or unlock the telescoping arm 21. Each pin 37 may be positioned in a sleeve or other guide 45 to maintain proper alignment.

Figure 3A:
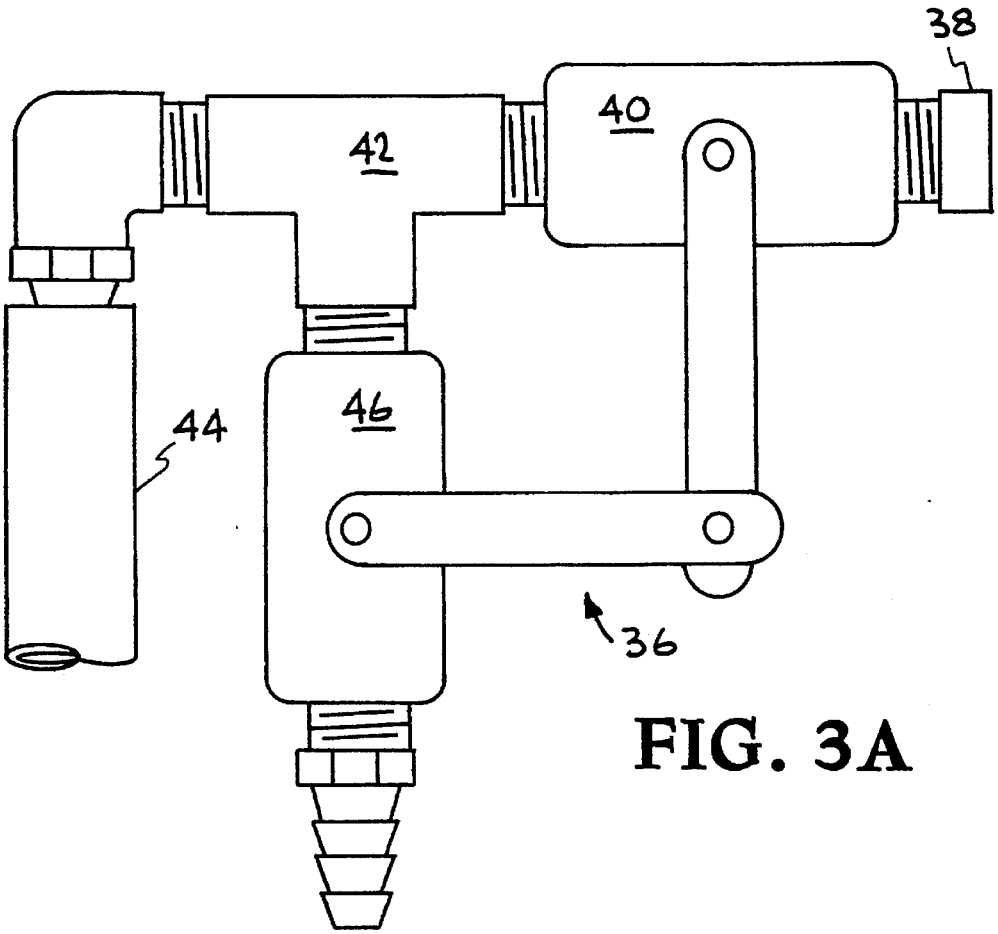
FIG. 3A is a diagram of the control valves.
Figure 3B:
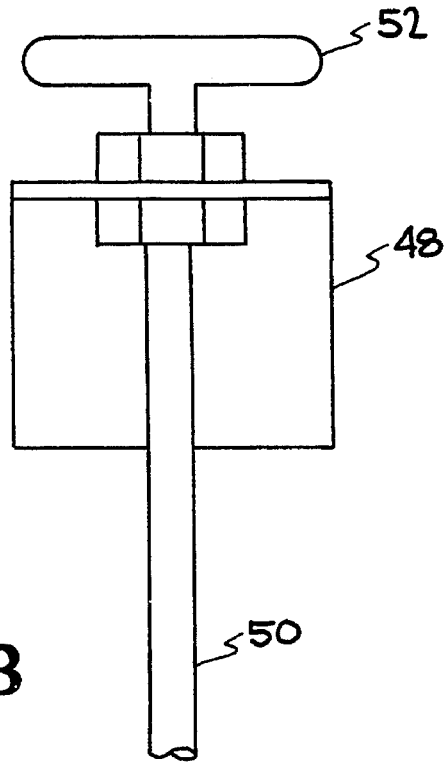
FIG. 3B is a diagram of the lock control mechanism.

FIGS. 3A, B illustrate the control valves and locking mechanism actuator of the boat lift 10. As shown in FIG. 3A, control valve assembly 36 has a water inlet 38 connected to an inlet valve 40 which is connected through tee 42 to inlet line 44 which goes to the rams 26. Tee 42 is also connected to outlet valve 46. Valve 40 is opened to actuate the rams 26 to raise the lift while valve 46 is closed. To lower the lift, valve 46 is opened while valve 40 is closed. FIG. 3B shows a push/pull cable mechanism 48 in which cable 50 is operated by handle 52 to actuate the locking mechanism 34 which inserts and removes the steel pins from the rams to lock and unlock the lift apparatus. The control valves of assembly 36 are conveniently mounted on the upper front of one of the floats 14.

The bunks 32 shown in FIGS. 1A,B and 2A–C which make contact with the boat hull are mounted on hinges 39 which allow the bunks to tilt to match the angle of the boat hull. The depth of the bunks can be adjusted during the assembly process to meet the needs for both deep and shallow boat hulls. This is done by raising or lowering the float supports which are predrilled for the two types of hulls.

The lift is constructed of hot dipped galvanized steel. Stainless steel bolts and Teflon bushings are used for all moving parts. The steel tubing used for the cantilever and rams is sleeved where the hinge bolts are used, in order to provide greater surface area making contact with the bolts. There is no metal to metal contact on the moving parts of the lift. The resulting lift has significant advantages in terms of safety and ease of operation.

Changes and modifications in the specifically described embodiments can be carried out without departing from the scope of the invention which is intended to be limited only by the scope of the appended claims.

We claim:

1. A boat lift comprising:

a pair of floats formed of polyurethane foam and a fiberglass casing enclosing the foam;

a plurality of mounting brackets bonded into the floats;

a base frame connected to the mounting brackets;

a pair of hydraulic rams pivotably mounted at one end to the base frame;

a first pair of cantilever arms pivotably mounted to the base frame at the opposite end of the base frame from said one end and having the distal ends of the hydraulic rams pivotably mounted thereto at the ends opposite the ends pivotably mounted to the base frame;

a second pair of cantilever arms pivotably mounted to said one end of the base frame;

a pair of boat hull bunks pivotably and hingedly connected from the first pair to the second pair of cantilever arms;

a locking mechanism for locking the hydraulic rams in an extended position with the first and second pair of cantilever arms in a raised position, said locking mechanism comprising a pair of pins and means for inserting and retracting said pins from the hydraulic rams.

2. The lift of claim 1 wherein the hydraulic rams are water powered.

3. The lift of claim 2 wherein the rams are powered by water at a pressure of about 50 psi.

4. The lift of claim 1 wherein the means for inserting and retracting comprises a cam mechanism and a cable for actuating the cam mechanism.

5. The lift of claim 1 further comprising a control valve assembly for the hydraulic rams.

6. The lift of claim 5 wherein the control valve assembly comprises an inlet valve for inputting a hydraulic fluid and an outlet valve for releasing a hydraulic fluid.

* * * * *